US009841700B2

(12) United States Patent
Kato et al.

(10) Patent No.: US 9,841,700 B2
(45) Date of Patent: Dec. 12, 2017

(54) IMAGE FORMING APPARATUS

(71) Applicant: FUJI XEROX CO., LTD., Tokyo (JP)

(72) Inventors: Nao Kato, Kanagawa (JP); Yusuke Kaji, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/244,062

(22) Filed: Aug. 23, 2016

(65) Prior Publication Data

US 2017/0277066 A1 Sep. 28, 2017

(30) Foreign Application Priority Data

Mar. 23, 2016 (JP) ..... 2016-058304

(51) Int. Cl.
*G03G 15/06* (2006.01)

(52) U.S. Cl.
CPC ..... *G03G 15/065* (2013.01)

(58) Field of Classification Search
CPC ..... G03G 15/065; G03G 15/0825
USPC ..... 399/55, 53
See application file for complete search history.

(56) References Cited

U.S. PATENT DOCUMENTS 4,684,239 A * 8/1987 Takayanagi ..... G03G 15/043 399/47
2009/0310993 A1 12/2009 Tamaoki
2015/0338762 A1* 11/2015 Nakagawa ..... G03G 15/043 399/51

FOREIGN PATENT DOCUMENTS

JP 2009-300932 A 12/2009
JP 2012-252324 A 12/2012

* cited by examiner

*Primary Examiner* — Billy Lactaoen
(74) *Attorney, Agent, or Firm* — Sughrue Mion, PLLC

(57) ABSTRACT

An image forming apparatus includes an image carrier that holds a developer image, a developer transport unit that transports a developer to the image carrier by performing a rotational movement, a voltage application unit that applies, between the developer transport unit and the image carrier, a voltage, which includes a direct-current (DC) voltage component and an alternating-current (AC) voltage component and which is used for moving the developer from the developer transport unit to the image carrier, and a density correction circuit that detects variations in a distance between the image carrier and the developer transport unit from variations in a waveform of an AC component of the voltage, which is applied by the voltage application unit, and that generates a control signal that causes the DC voltage component to change in such a manner that density variations due to the variations in the distance are corrected.

9 Claims, 7 Drawing Sheets

CONVERT CURRENT OF AC COMPONENT SIGNAL OF DEVELOPING BIAS INTO VOLTAGE BY R1

OUTPUT OF BUFFER CIRCUIT 51

OUTPUT OF RECTIFIER CIRCUIT 52

OUTPUT OF DIFFERENTIAL AMPLIFIER CIRCUIT 53

OUTPUT OF INVERTING AMPLIFIER CIRCUIT 54

DC CONTROL SIGNAL (OUTPUT OF DC VOLTAGE REGULATING CIRCUIT 55)

IMAGE FORMING APPARATUS

CROSS-REFERENCE TO RELATED APPLICATIONS

This application is based on and claims priority under 35 USC 119 from Japanese Patent Application No. 2016-058304 filed Mar. 23, 2016.

BACKGROUND (i) Technical Field

The present invention relates to an image forming apparatus.

(ii) Related Art

In an image forming apparatus that forms an image by using a developer, such a toner, a developing bias is applied between a developing roller and a photoconductor drum in such a manner as to move the developer, such as toner, from the developing roller to the photoconductor drum, and an electrostatic latent image formed on the photoconductor drum is developed.

However, since the developing roller and the photoconductor drum do not have a perfect circular shape due to manufacturing tolerances, variations in a gap between the developing roller and the photoconductor drum occur as a result of the developing roller and the photoconductor drum rotating, and variations in the density of an image that is to be developed on the developing roller also occur.

In order to suppress such density variations, density corrections for suppressing density variations have been performed by detecting variations in the gap between the photoconductor drum and the developing roller by using a unit, such as a microcontroller unit (MCU), that uses software control.

However, in such a method, the number of connections between a controller and a developing-bias applying device increases.

SUMMARY

According to an aspect of the invention, there is provided an image forming apparatus including an image carrier that holds a developer image, a developer transport unit that transports a developer to the image carrier by performing a rotational movement, a voltage application unit that applies, between the developer transport unit and the image carrier, a voltage, which includes a direct-current (DC) voltage component and an alternating-current (AC) voltage component and which is used for moving the developer from the developer transport unit to the image carrier, and a density correction circuit that detects variations in a distance between the image carrier and the developer transport unit from variations in a waveform of an AC component of the voltage, which is applied by the voltage application unit, and that generates a control signal that causes the DC voltage component to change in such a manner that density variations due to the variations in the distance are corrected.

BRIEF DESCRIPTION OF THE DRAWINGS

Exemplary embodiments of the present invention will be described in detail based on the following figures, wherein.

DETAILED DESCRIPTION

An exemplary embodiment of the present invention will now be described in detail with reference to the drawings.

Figure 1:
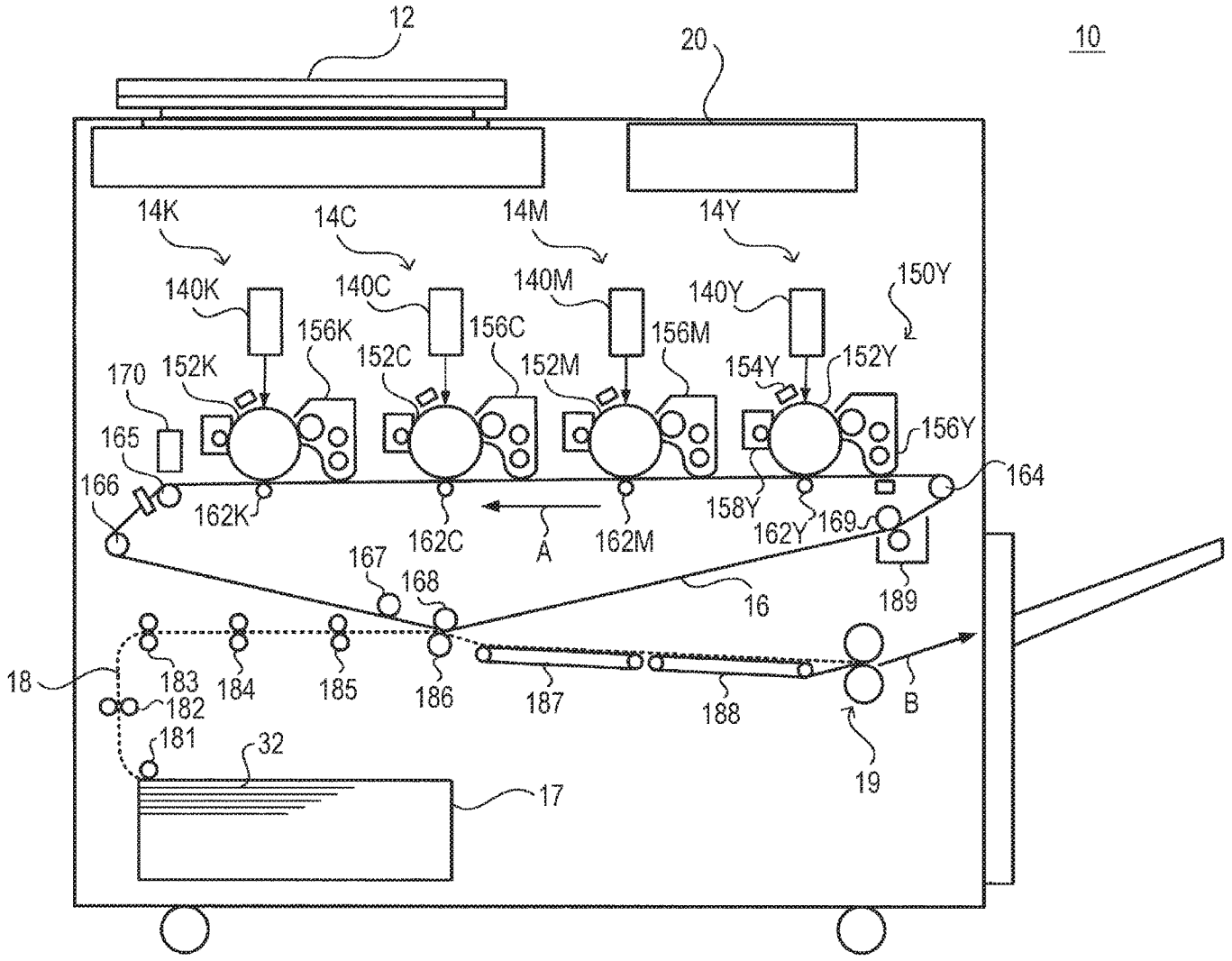
FIG. 1 is a diagram illustrating a configuration of an image forming apparatus according to an exemplary embodiment of the present invention.

FIG. 1 is a diagram illustrating the configuration of an image forming apparatus 10 according to the exemplary embodiment of the present invention.

As illustrated in FIG. 1, the image forming apparatus 10 includes an image reading device 12, image forming units 14K, 14C, 14M, and 14Y, an intermediate transfer belt 16, a sheet tray 17, a sheet transport path 18, a fixing unit 19, and a controller 20. The image forming apparatus 10 may be a multifunction machine that has a printer function that prints image data, which is received from a personal computer (not illustrated) or the like, and also has a function of serving as a full-color copying machine using the image reading device 12 and a function of serving as a facsimile machine.

An overview of the image forming apparatus 10 will be described first. The image reading device 12 and the controller 20 are disposed in an upper portion of the image forming apparatus 10 and each function as a unit for inputting image data. The image reading device 12 reads an image of a document and outputs the image data to the controller 20. The controller 20 performs image processing, such as gradation correction and resolution correction, on image data input to the controller 20 from the image reading device 12 or image data input to the controller 20 from a personal computer (not illustrated) or the like via a network line, such as a LAN, and then outputs the image data to the image forming units 14.

The four image forming units 14K, 14C, 14M, and 14Y, each of which corresponds to one of the colors of color images, are disposed below the image reading device 12. In the present exemplary embodiment, the four image forming units 14K, 14C, 14M, and 14Y that correspond to black (K), cyan (C), magenta (M), and yellow (Y), respectively, are horizontally arranged with a predetermined interval therebetween along the intermediate transfer belt 16. The intermediate transfer belt 16 serves as an intermediate transfer body and moves in the direction of arrow A in FIG. 1. The four image forming units 14K, 14Y, 14M, and 14C sequentially form toner images of the corresponding colors on the basis of image data input from the controller 20 and transfer (in a first transfer process) the toner images onto the intermediate transfer belt 16 at the timing at which the toner images are superposed with one another. Note that the image forming units 14K, 14C, 14M, and 14Y are not limited to being arranged in the order of colors K, C, M, and Y and may be in any order (e.g., Y, M, C, and K).

The sheet transport path 18 is disposed below the intermediate transfer belt 16. One of the recording sheets 32 that is supplied from the sheet tray 17 is transported along the sheet transport path 18, and toner images of the different colors, which have been transferred to the intermediate transfer belt 16 in such a manner as to be superposed with one another, are collectively transferred (in a second transfer process) onto the recording sheet 32. Then, the toner images, which have been transferred to the recording sheet 32, is fixed onto the recording sheet 32 by the fixing unit 19, and the recording sheet 32 is ejected to the outside in the direction of arrow B.

The configuration of each unit included in the image forming apparatus 10 will now be described in further detail.

The controller 20 performs predetermined image processing, such as shading correction, document misregistration correction, brightness/color space conversion, gamma correction, frame erasure, and color/movement editing, on image data read by the image reading device 12. Note that optical images reflected from a color material of the document, which is read by the image reading device 12, are document-reflectance data items, each of which has one of three colors of, for example, red (R), green (G), and blue (B) and each of which is composed of 8 bits, and these document reflectance data items are converted into, through the image processing performed by the controller 20, document-color-material-gradation data items, each of which has one of four colors of K, C, M, and Y and each of which is composed of 8 bits.

The image forming units (image forming units) 14K, 14C, 14M, and 14Y are arranged side by side with a predetermined interval therebetween in the horizontal direction, and the configurations of the image forming units 14K, 14C, 14M, and 14Y are substantially similar to one another except for the colors of images formed by the image forming units 14K, 14C, 14M, and 14Y. Accordingly, the image forming unit 14K will be described below. Note that the configurations of the image forming units 14 will be described in such a manner as to be distinguished in terms of color by adding the letters K, C, M, and Y to the reference numeral 14.

The image forming unit 14K includes a light scanning device 140K that causes a laser beam to scan a photoconductor drum 152K in accordance with image data, which is input from the controller 20, and an image forming device 150K that forms an electrostatic latent image by using the laser beam, which is caused to scan the photoconductor drum 152K by the light scanning device 140K.

The light scanning device 140K modulates the laser beam in accordance with a black (K) image data and radiates the modulated laser beam onto the photoconductor drum 152K of the image forming device 150K.

The image forming device 150K includes the photoconductor drum 152K that performs a rotational movement in the direction of arrow A at a predetermined rotation speed, a charging device 154K serving as a charging unit that uniformly charges a surface of the photoconductor drum 152K, a developing device 156K that develops an electrostatic latent image formed on the photoconductor drum 152K, and a cleaning device 158K. The photoconductor drum 152K is an image carrier that has a cylindrical shape and holds a developer image, such as a toner image, and is uniformly charged by the charging device 154K. An electrostatic latent image is formed on the photoconductor drum 152K by the laser beam that is radiated from the light scanning device 140K. The electrostatic latent image formed on the photoconductor drum 152K is developed by the developing device 156K with a developer, such as a K color toner, and is transferred onto the intermediate transfer belt 16. Note that residual toner, paper dust, and the like that remain on the photoconductor drum 152K after a process of transferring a toner image (developer image) has been executed are removed by the cleaning device 158K.

Similarly to the image forming unit 14K, the image forming unit 14C includes a photoconductor drum 152C and a developing device 156C and forms a C color toner image. The image forming unit 14M includes a photoconductor drum 152M and a developing device 156M and forms an M color toner image. The image forming unit 14Y includes a photoconductor drum 152Y and a developing device 156Y and forms a Y color toner image. The toner images of the different colors, which are formed by the image forming units 14C, 14M, and 14Y, are transferred onto the intermediate transfer belt 16.

The intermediate transfer belt 16 is stretched by a drive roller 164, idle rollers 165, 166, and 167, a backup roller 168, and an idle roller 169 with a certain tension and is driven so as to rotate at a predetermined speed in the direction of arrow A as a result of the drive roller 164 being driven by a drive motor (not illustrated) so as to rotate. The intermediate transfer belt 16 has the form of an endless belt obtained by, for example, forming a flexible film made of a synthetic resin, such as a polyimide, into a belt-like shape and joining the ends of the synthetic resin film, which is formed in a belt-like shape, to each other by welding or the like.

First transfer rollers 162K, 162C, 162M, and 162Y are disposed at positions on the intermediate transfer belt 16, the positions each facing a corresponding one of the image forming units 14K, 14C, 14M, and 14Y, and toner images of the different colors formed on the photoconductor drums 152K, 152C, 152M, and 152Y are transferred onto the intermediate transfer belt 16 in such a manner as to be superposed with one another by the first transfer rollers 162. Note that residual toner that remains on the intermediate transfer belt 16 is removed by a cleaning blade or a brush of a belt cleaning device 189 that is disposed at a position downstream from a second transfer position.

A density sensor 170 is disposed in the vicinity of the intermediate transfer belt 16. The density sensor 170 is a sensor that is used for reading toner images that have been transferred to the intermediate transfer belt 16.

A sheet feed roller 181 that picks up one of the recording sheets 32 from the sheet tray 17, a first pair of rollers 182, a second pair of rollers 183, and a third pair of rollers 184 that are used for transporting the recording sheet 32, and registration rollers 185 that transport the recording sheet 32 to the second transfer position at a predetermined timing are disposed on the sheet transport path 18.

A second transfer roller 186 that is pressed into contact with the backup roller 168 is disposed at the second transfer position on the sheet transport path 18, and toner images of the different colors, which have been transferred to the intermediate transfer belt 16 in such a manner as to be superposed with one another, are transferred in the second transfer process onto the recording sheet 32 with a press-contact force and an electrostatic force exerted by the second transfer roller 186. The recording sheet 32, to which the toner images of the different colors have been transferred, is transported to the fixing unit 19 by a transport belt 187 and a transport belt 188.

The fixing unit 19 performs a heat treatment and a pressure treatment on the recording sheet 32, to which the toner images of the different colors have been transferred, so as to cause the toners to melt and become fixed onto the recording sheet 32.

Note that the developing device 156K includes a developing roller (developer transport unit) 157K that has a cylindrical shape and transports the developer to the photoconductor drum 152K by performing a rotational movement so as to form a developer image on the photoconductor drum 152K. Regarding the image forming units 14C, 14M, and 14Y, which form images of the other colors, similar to the image forming unit 14K, a developing roller is provided in each of the developing devices 156C, 156M, and 156Y.

A relationship between the photoconductor drum 152K and the developing roller 157K in the image forming apparatus 10 according to the present exemplary embodiment will now be described with reference to FIG. 2. Note that, FIG. 2 only illustrates the configuration for forming a black image, and the configurations for forming images of the other colors of cyan, magenta, and yellow are similar to the configuration for forming a black image.

Figure 2:
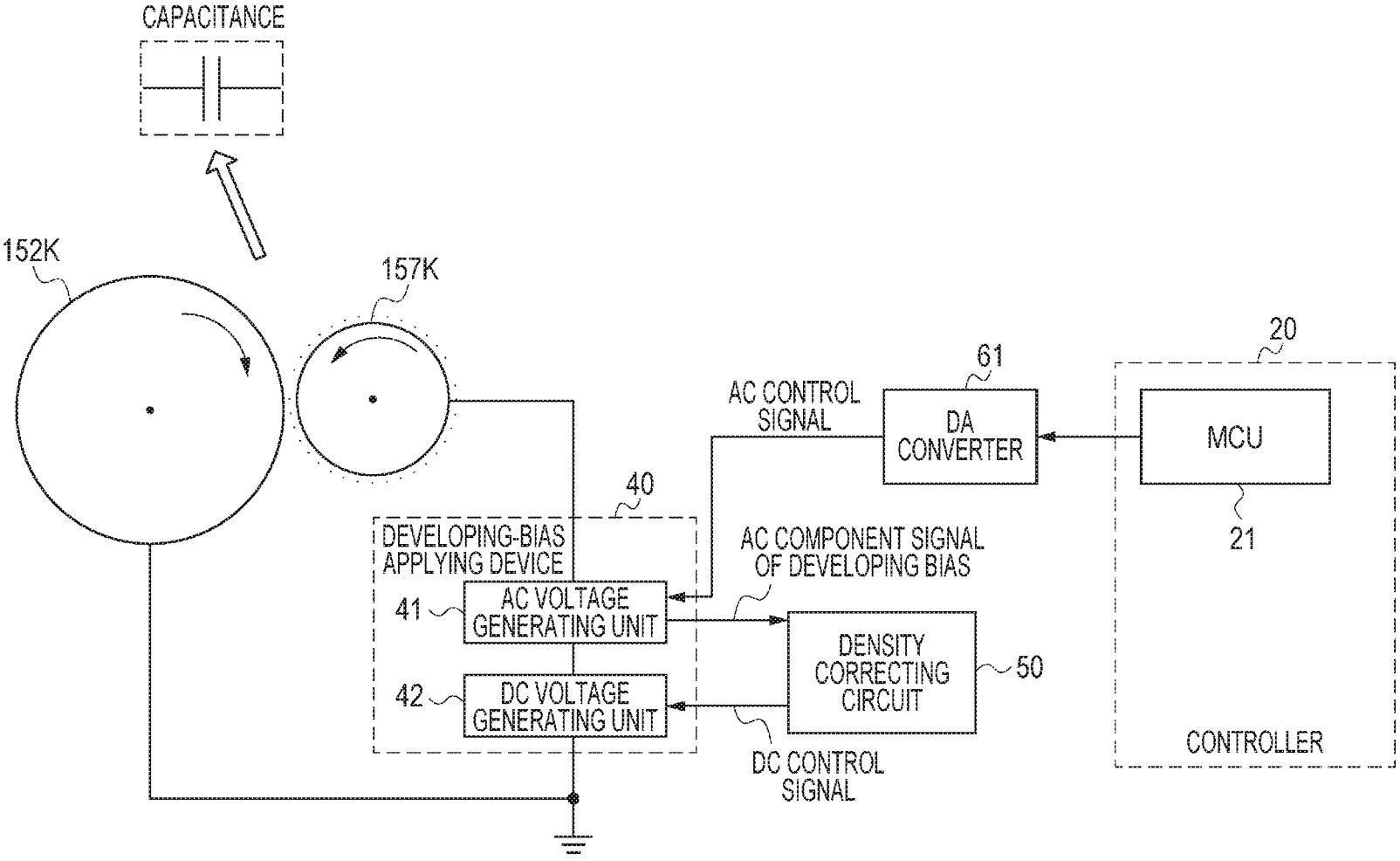
FIG. 2 is a diagram illustrating a relationship between a photoconductor drum and a developing roller in the image forming apparatus according to the exemplary embodiment of the present invention.

As illustrated in FIG. 2, the photoconductor drum 152K and the developing roller 157K are arranged in such a manner as to face each other with a predetermined interval (gap) therebetween. The developing roller 157K holds the developer on its surface by a magnetic force of a magnet, which is disposed within the developing roller 157K, and transports the developer, which has been held on the surface of the developing roller 157K, to the gap formed between the developing roller 157K and the photoconductor drum 152K by performing a rotational movement so as to develop an electrostatic latent image formed on the surface of the photoconductor drum 152K into a visible image.

As illustrated in FIG. 2, the image forming apparatus 10 according to the present exemplary embodiment includes a developing-bias applying device 40, a density correcting circuit 50, and a digital-to-analog (DA) converter 61.

The developing-bias applying device 40 is a voltage application unit that applies, between the developing roller 157K and the photoconductor drum 152K, a voltage (developing bias), which is formed of a direct-current voltage component (DC voltage component) and an alternating-current voltage component (AC voltage component) and used for transporting the developer from the developing roller 157K to the photoconductor drum 152K.

The developing-bias applying device 40 includes an alternating current (AC) voltage generating unit 41 and a direct-current (DC) voltage generating unit 42.

The DC voltage generating unit 42 is a DC voltage generating unit that generates a voltage having a DC component, and the AC voltage generating unit 41 is an AC voltage generating unit that generates a voltage having an AC component.

A developing bias that is obtained by superposing the voltage having the AC component, which is generated by the AC voltage generating unit 41, on the voltage having the DC component, which is generated by the DC voltage generating unit 42, is applied between the developing roller 157K and the photoconductor drum 152K. For example, the voltage having the AC component is a signal of 1 kVp-p having a frequency of 6 kHz, and the voltage having the DC component (DC bias) is a voltage of 300 V.

Here, the DC voltage generating unit 42 is configured to generate a voltage based on a DC control signal from the outside, and the AC voltage generating unit 41 is configured to generate a voltage based on an AC control signal from the outside. Note that the DC control signal and the AC control signal are each an analog control signal, and an AC voltage and a DC voltage respectively corresponding to the AC control signal and the DC control signal are generated.

In addition, a monitor signal that is proportional to the voltage having the AC component, which is generated by the AC voltage generating unit 41, is output as an AC component signal of the developing bias by the AC voltage generating unit 41 to the outside.

Here, the photoconductor drum 152K, the developing roller 157K, and the developer and the air, which are interposed between the photoconductor drum 152K and the developing roller 157K, are formed of metal members and a high-resistance material interposed between the metal members. Thus, the photoconductor drum 152K and the developing roller 157K function in a similar way to a capacitor and have a capacitance.

If the photoconductor drum 152K, the developing roller 157K, and the like are each have an ideal shape, the capacitance would be a fixed value. However, since the cross-sectional shape of each of the photoconductor drum 152K and the developing roller 157K is not always a perfect circle due to manufacturing tolerances and the like of the photoconductor drum 152K and the developing roller 157K, the gap between the photoconductor drum 152K and the developing roller 157K changes upon rotational movements of the photoconductor drum 152K and the developing roller 157K, and the capacitance of the capacitor, which is formed of the photoconductor drum 152K and the developing roller 157K, also varies. As a result of the capacitance varying, the value of the current of the AC voltage component that flows into the developing roller 157K also varies.

As a result of the AC component signal of the developing bias, which is output by the AC voltage generating unit 41, being input to the density correcting circuit 50, the density correcting circuit 50 detects variations in the distance between the photoconductor drum 152K and the developing roller 157K by referencing to variations in the waveform of the AC component signal of the developing bias, which is applied by the developing-bias applying device 40, and generates the DC control signal that causes the DC voltage component of the developing bias to change in such a manner as to correct density variations that occur due to the variations in the distance between the photoconductor drum 152K and the developing roller 157K.

The DC voltage generating unit 42 changes the DC voltage, which is generated by the DC voltage generating unit 42, on the basis of the DC control signal generated by the density correcting circuit 50.

Note that the density correcting circuit 50 is formed of a hardware circuit and generates the DC control signal for controlling the DC voltage, which is generated by the DC voltage generating unit 42, from the waveform of the AC component of the developing bias, which is applied by the developing-bias applying device 40, without being controlled by software.

Note that the controller 20 includes a microcontroller unit (MCU) 21 that controls a developing operation and the like by software control. The MCU 21 controls the voltage having the AC component, which is generated by the AC voltage generating unit 41, and a digital signal that is output by the MCU 21 is converted into the analog AC control signal by the DA converter 61 and is output to the AC voltage generating unit 41. As a result, the value of the voltage having the AC component, which is generated by the AC voltage generating unit 41, is controlled.

A specific circuit configuration of the density correcting circuit 50 will now be described with reference to FIG. 3.

Figure 3:
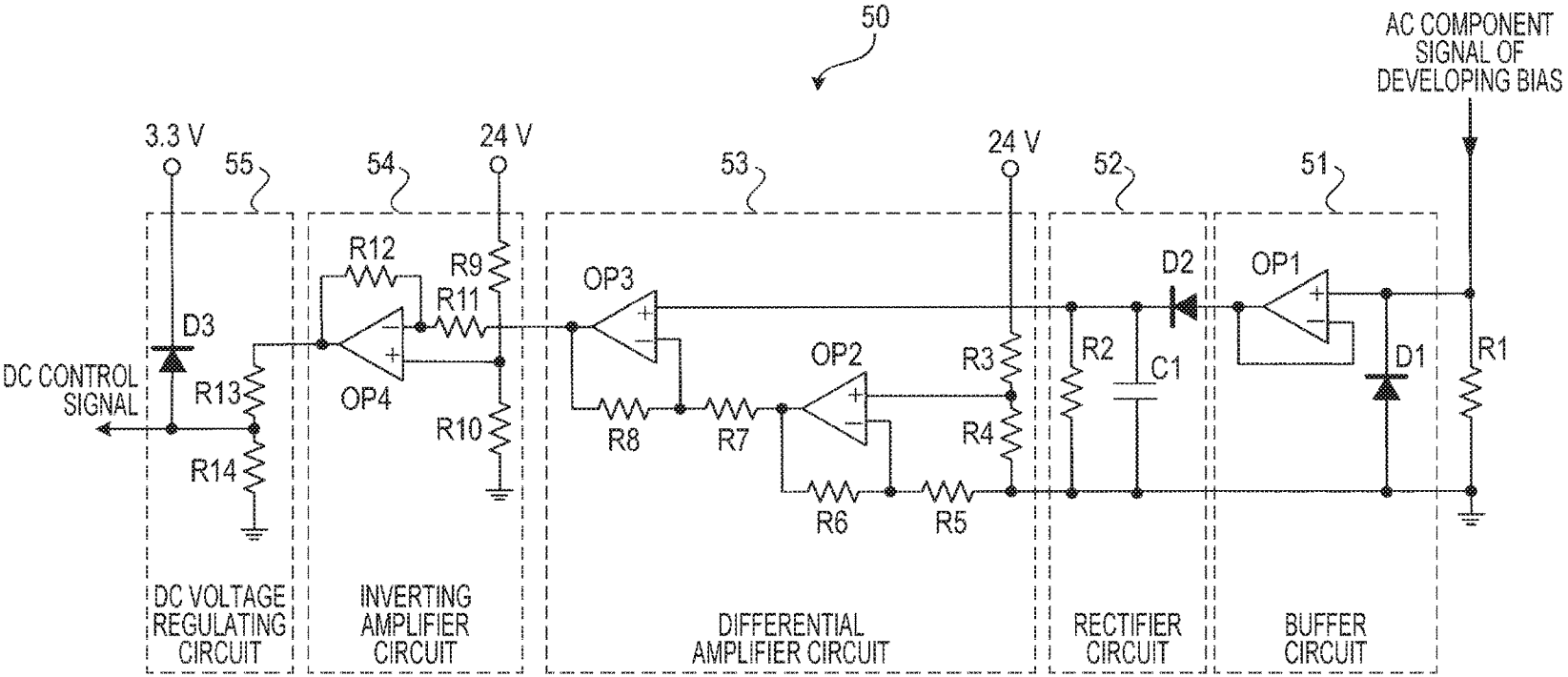
FIG. 3 is a diagram illustrating a specific circuit configuration of a density correction circuit.

As illustrated in FIG. 3, the density correcting circuit 50 includes a buffer circuit 51, a rectifier circuit 52 that rectifies an AC component waveform, a differential amplifier circuit 53 that performs a level adjustment of the waveform that has been rectified by the rectifier circuit 52, an inverting amplifier circuit 54 that inverts a signal component of the waveform on which the level adjustment has been performed by the differential amplifier circuit 53, and a DC voltage regulating circuit 55.

FIGS. 4B to 4F illustrate signal waveforms each of which has passed through one of the circuits in the density correcting circuit 50 illustrated in FIG. 3.

Figures 4A, 4B, 4C, 4D, 4E, 4F:
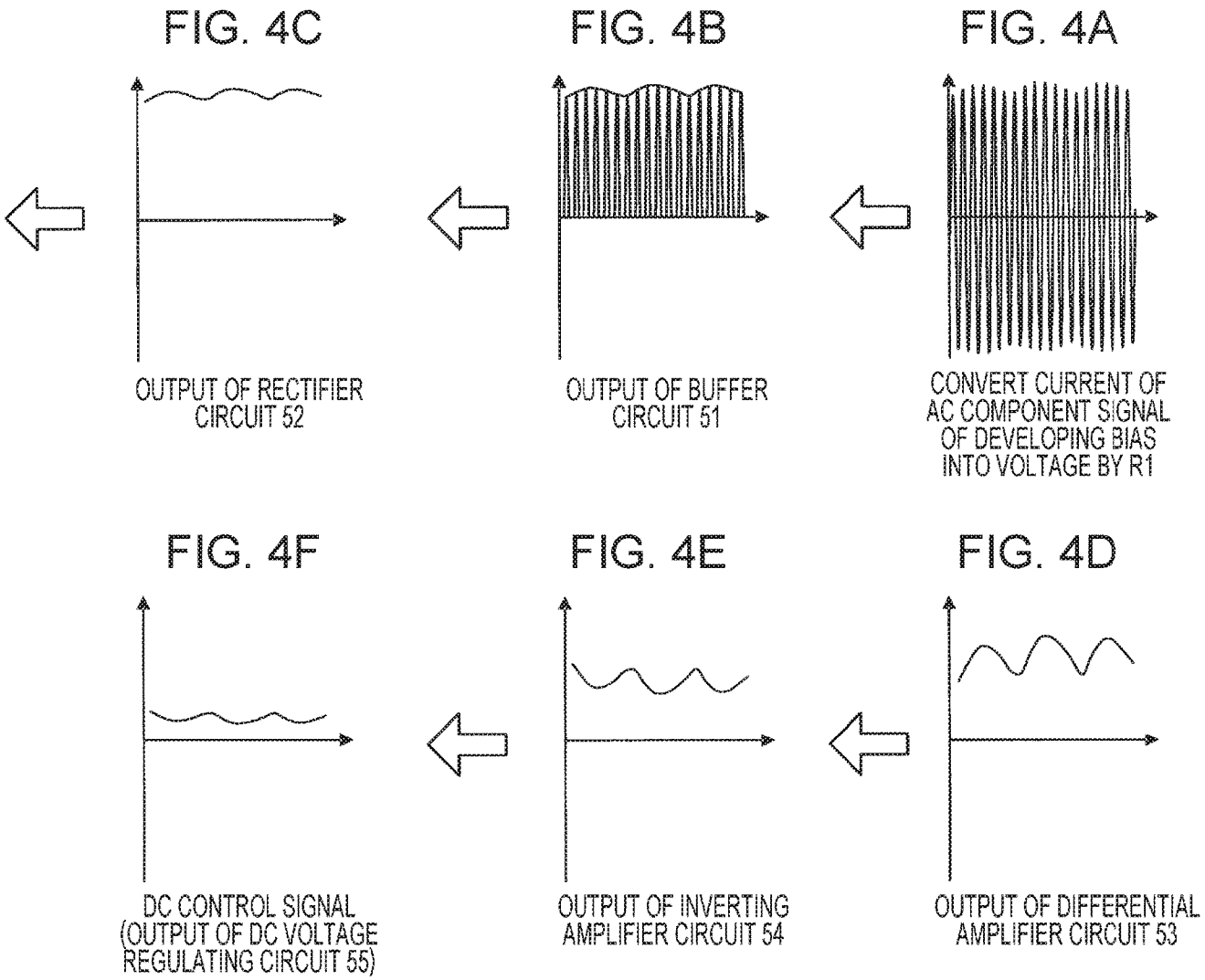
FIGS. 4A to 4F are diagrams each illustrating a signal waveform that has passed through one of circuits in the density correction circuit illustrated in FIG. 3.

A current signal of the AC component of the developing bias output by the AC voltage generating unit 41 is output to a resistor R1 first and converted into a voltage waveform. An exemplary voltage waveform that is generated in this manner is illustrated in FIG. 4A. The exemplary voltage waveform illustrated in FIG. 4A is, for example, a waveform of a voltage of 10 Vp-p.

A waveform that is obtained after the voltage waveform illustrated in FIG. 4A has passed through the buffer circuit 51 is illustrated in FIG. 4B. The buffer circuit 51 includes a diode D1 and an operational amplifier OP1, and it is understood that a negative voltage component is cut by the diode D1 in the buffer circuit 51.

A signal waveform that is obtained after the signal waveform illustrated in FIG. 4B has passed through the rectifier circuit 52 is illustrated in FIG. 4C. The rectifier circuit 52 includes a diode D2, a capacitor C1, and a resistor R2. The rectifier circuit 52 rectifies and outputs an output waveform of the buffer circuit 51.

A signal waveform that is obtained after the signal waveform illustrated in FIG. 4C has passed through the differential amplifier circuit 53 is illustrated in FIG. 4D. The differential amplifier circuit 53 includes resistors R3 to R8 and operational amplifiers OP2 and OP3 and functions as a gain adjustment circuit that performs a level adjustment of the signal waveform that has been rectified by the rectifier circuit 52. An output waveform of the rectifier circuit 52 is output after its amplitude and bias have been changed by the differential amplifier circuit 53.

A signal waveform that is obtained after the signal waveform illustrated in FIG. 4D has passed through the inverting amplifier circuit 54 is illustrated in FIG. 4E. The inverting amplifier circuit 54 includes resistors R9 to R12 and an operational amplifier OP4. The inverting amplifier circuit 54 performs inverting amplification of the signal waveform, whose amplitude and bias have been changed by the differential amplifier circuit 53, and performs processing of inverting the amplitude.

A signal waveform that is obtained after the signal waveform illustrated in FIG. 4E has passed through the DC voltage regulating circuit 55 is illustrated in FIG. 4F. The DC voltage regulating circuit 55 includes resistors R13 and R14 and a diode D3 and performs processing of decreasing the voltage to the signal level of a DC control voltage by dividing the voltage of the signal waveform from the inverting amplifier circuit 54 by the resistance ratio of the resistors R13 to R14. Note that the diode D3 is a diode for preventing overvoltage that is used for controlling the upper limit of the voltage of the DC control signal in such a manner that the voltage of the DC control signal will not become overvoltage.

Since the density correcting circuit 50 has a circuit configuration such as that illustrated in FIG. 3, as a result of the AC component signal of the developing bias being input to the density correcting circuit 50, the density correcting circuit 50 generates the DC control signal for controlling the voltage of the DC control signal of the developing bias.

Figure 5:
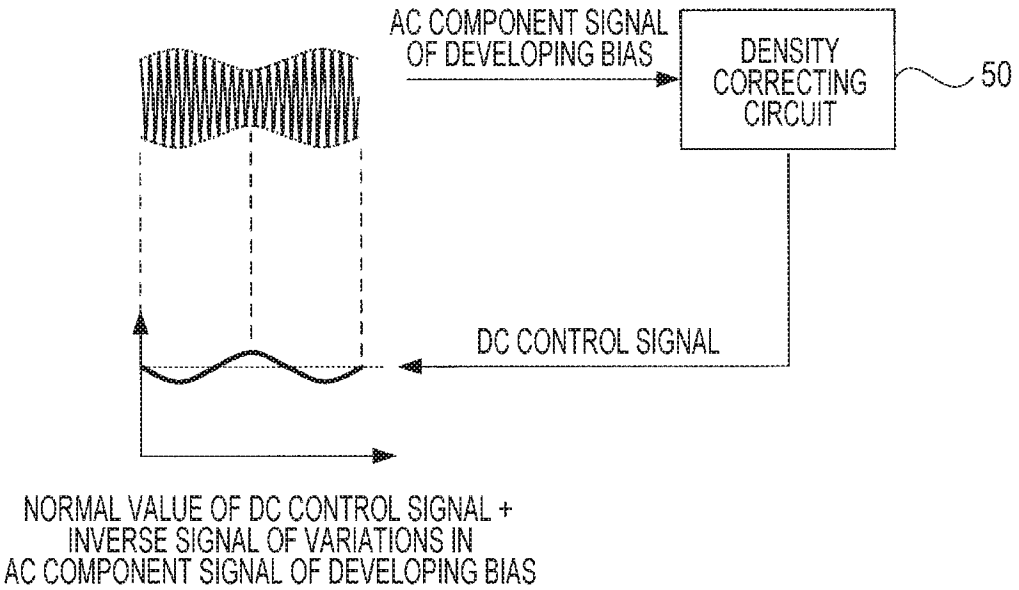
FIG. 5 is a diagram illustrating a state in which the density correction circuit performs control in such a manner that the density correction circuit decreases the voltage of a DC control signal when the amplitude of a signal waveform of an AC component of a developing bias is large and increases the voltage of the DC control signal when the amplitude of the signal waveform of the AC component of the developing bias is small.

In other words, as illustrated in FIG. 5, the density correcting circuit 50 performs control in such a manner as to suppress density variations that occur due to variations in the distance between the photoconductor drum 152K and the developing roller 157K by decreasing the voltage of the DC control signal when the amplitude of the signal waveform of the AC component of the developing bias is large and increasing the voltage of the DC control signal when the amplitude of the signal waveform of the AC component of the developing bias is small.

Figure 6:
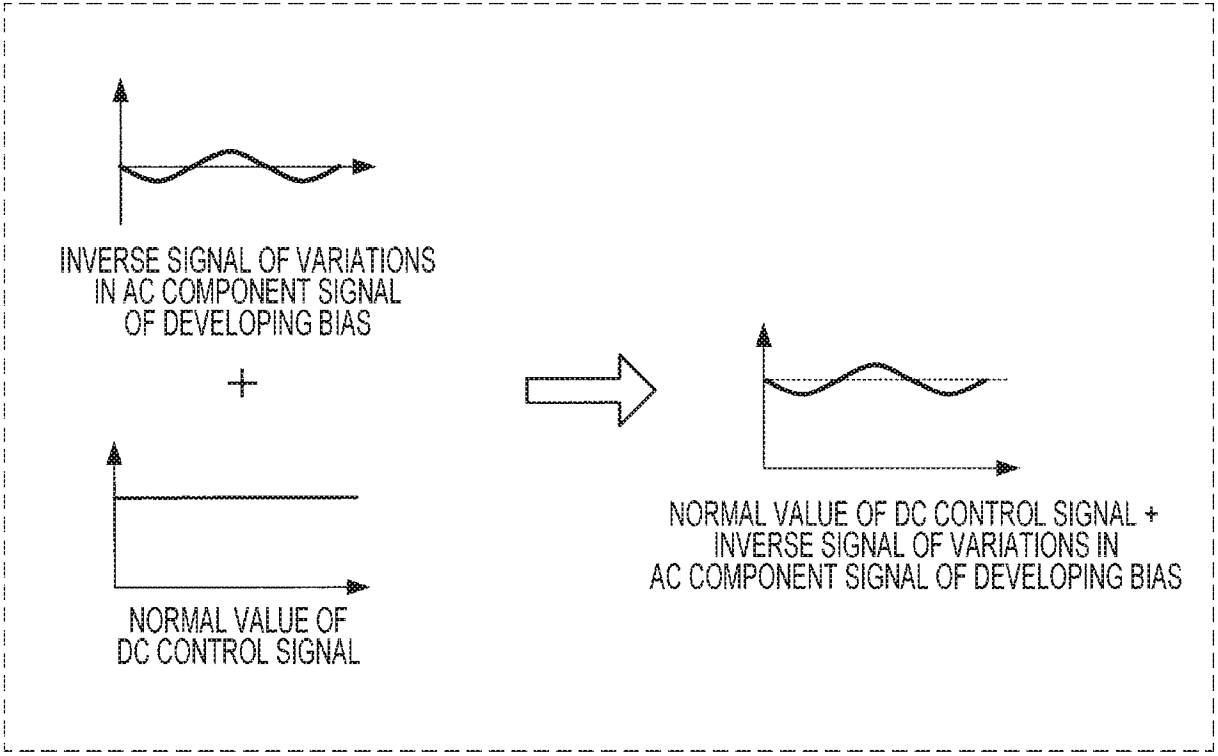
FIG. 6 is a diagram illustrating a state in which the density correction circuit superposes an inverse signal, which is obtained by inverting long-period variations in the AC component of the developing bias, on a constant voltage and outputs the inverse signal and the constant voltage as the DC control signal.

Note that, in the case where there is no variation in the AC component of the developing bias, the density correcting circuit 50 outputs, as the DC control signal, a constant voltage that causes the DC voltage generating unit 42 to generate an appropriate DC voltage. In the case where there are variations in the AC component of the developing bias, as illustrated in FIG. 6, the density correcting circuit 50 superposes an inverse signal, which is obtained by inverting the long-period variations in the AC component of the developing bias, on the constant voltage and outputs the inverse signal and the constant voltage as the DC control signal. Note that the long-period variations in the AC component of the developing bias correspond to the rotation period of the developing roller 157K.

In the above-described exemplary embodiment, correction of density variations that occur due to variations in the distance between the photoconductor drum 152K and the development roller 157K is achieved by the density correction circuit 50. In contrast, a configuration example in the case where the correction of density variations is performed by an MCU is illustrated in FIG. 7.

Figure 7:
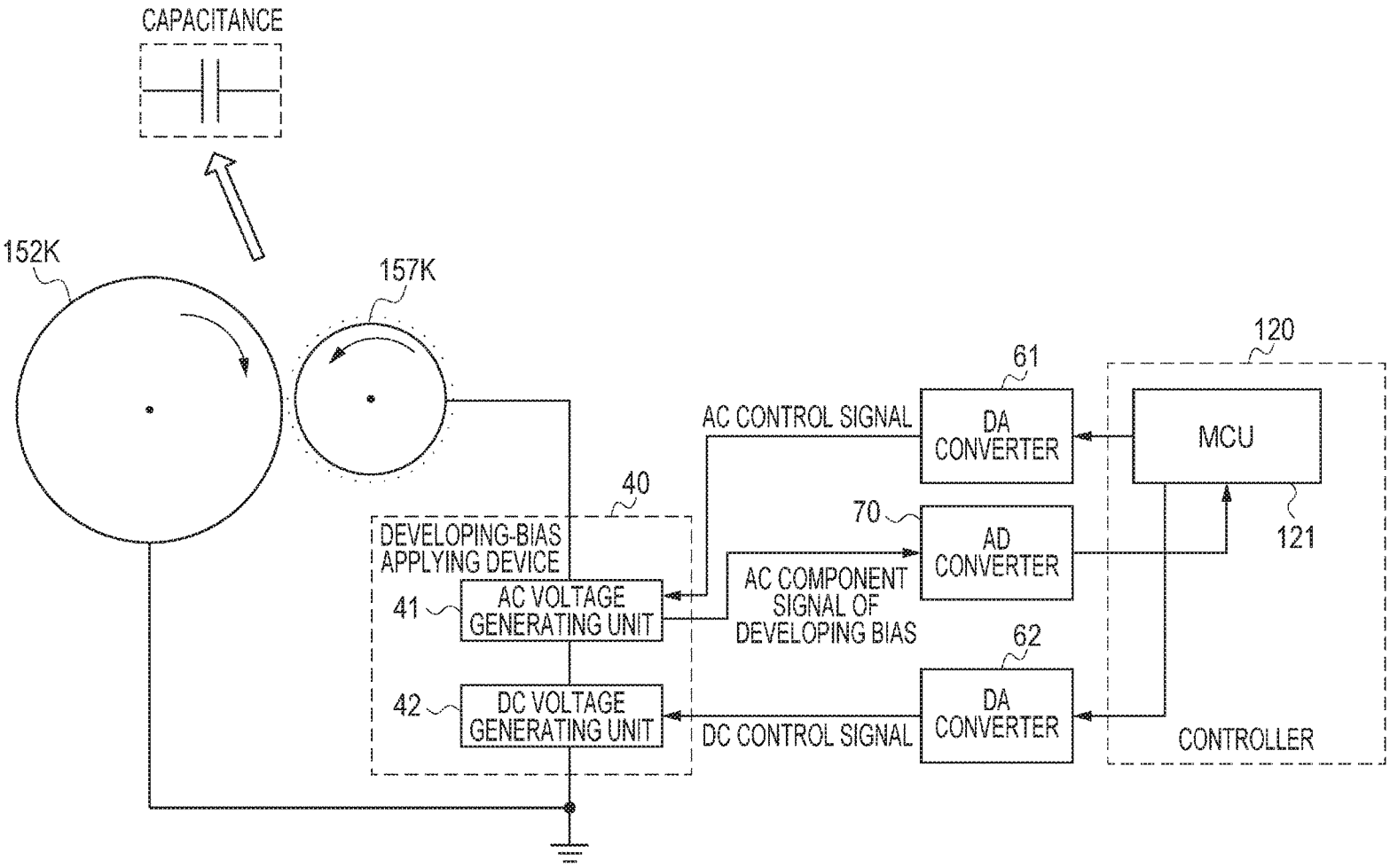
FIG. 7 is a diagram illustrating a configuration in the case where an MCU performs density correction.

In FIG. 7, an AD converter 70 and a DA converter 62 are provided instead of the density correction circuit 50. An MCU 121 in a controller 120 performs the processing of correcting density variations, which is performed by the density correcting circuit 50 in the above exemplary embodiment, by software control.

More specifically, the AC component signal of the developing bias from the AC voltage generating unit 41 is converted into a digital signal by the AD converter 70 and is input to the MCU 121. The MCU 121 detects variations in the AC component of the developing bias by using the digital signal and outputs an inverse signal of the variations to the DA converter 62. The DA converter 62 generates a DC control signal by converting the digital signal from the MCU 121 into an analog signal and outputs the DC control signal to the DC voltage generating unit 42.

In the above-described manner, in the case where the processing that is performed by the density correction circuit 50 in the above exemplary embodiment is achieved by the software control performed by the MCU 121, as seen when comparing FIG. 2 and FIG. 7, the number of connections between the controller 20 (120) and the developing-bias applying device 40 increases.

Although the number of connections between the controller 20 and the developing-bias applying device 40 is only one in FIG. 2, it is understood from FIG. 7 that it is necessary that the number of connections between the controller 120 and the developing-bias applying device 40 be three.

In addition, a delay generally does not occur in control using a hardware circuit, and in contrast to this, a delay occurs in processing performed by software control.

Consequently, since the correction of density variations is achieved by the software control performed by the MCU 121 in FIG. 7, there is a probability of a processing delay occurring whereas a processing delay would not occur in the correction of density variations performed by using a hardware circuit such as that illustrated in FIG. 2.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image carrier configured to hold a developer image;

a developer transport unit configured to transport a developer to the image carrier by performing a rotational movement;

a voltage application unit configured to apply, between the developer transport unit and the image carrier, a voltage which includes a direct-current (DC) voltage component and an alternating-current (AC) voltage component and which is used for moving the developer from the developer transport unit to the image carrier; and a density correction circuit configured to detect variations in a distance between the image carrier and the developer transport unit from variations in a waveform of an AC component of the voltage, which is applied by the voltage application unit, and configured to generate a control signal that causes the DC voltage component to change in such a manner that density variations due to the variations in the distance are corrected, wherein the control signal causes the DC voltage component to change continuously and in inverse proportion to the waveform of the AC component of the voltage, wherein the density correction circuit comprises:

a rectifier circuit configured to rectify the waveform of the AC component;

an adjustment circuit configured to perform a level adjustment of the waveform that has been rectified by the rectifier circuit; and an inverting circuit configured to invert a signal component of the waveform on which the level adjustment has been performed by the adjustment circuit.

2. The image forming apparatus according to claim 1, wherein the voltage application unit comprises a DC voltage generating unit configured to generate a voltage having the DC voltage component, and an AC voltage generating unit configured to generate a voltage having the AC voltage component, and wherein the DC voltage generating unit is configured to change a DC voltage, which is generated by the DC voltage generating unit, based on the control signal generated by the density correction circuit.

3. The image forming apparatus according to claim 2, wherein the density correction circuit is formed of a hardware circuit and is configured to generate the control signal for controlling the DC voltage, which is generated by the DC voltage generating unit, from the waveform of the AC component of the voltage, which is applied by the voltage application unit, without being controlled by software.

4. An image forming apparatus comprising:

an image carrier configured to hold a developer image;

a developer transport unit configured to transport a developer to the image carrier by performing a rotational movement;

a voltage application unit configured to apply, between the developer transport unit and the image carrier, a voltage which includes a direct-current (DC) voltage component and an alternating-current (AC) voltage component and which is used for moving the developer from the developer transport unit to the image carrier; and a density correction circuit configured to detect variations in a distance between the image carrier and the developer transport unit from variations in a waveform of an AC component of the voltage, which is applied by the voltage application unit, and configured to generate a control signal that causes the DC voltage component to change in such a manner that density variations due to the variations in the distance are corrected, wherein the density correction circuit comprises a rectifier circuit configured to rectify the waveform of the AC component, an adjustment circuit configured to perform a level adjustment of the waveform that has been rectified by the rectifier circuit, and an inverting circuit configured to invert a signal component of the waveform on which the level adjustment has been performed by the adjustment circuit.

5. The image forming apparatus according to claim 1, wherein the adjustment circuit comprises a differential amplifier circuit.

6. The image forming apparatus according to claim 2, wherein the adjustment circuit comprises a differential amplifier circuit.

7. The image forming apparatus according to claim 3, wherein the adjustment circuit comprises a differential amplifier circuit.

8. The image forming apparatus according to claim 4, wherein the adjustment circuit comprises a differential amplifier circuit.

9. The image forming apparatus according to claim 4, wherein the voltage application unit comprises a DC voltage generating unit and an AC voltage generating unit, the DC voltage generating unit being configured to generate a voltage based on the control signal generated by the density correction circuit.

* * * * *